US009867510B2

(12) United States Patent
Bethel

(10) Patent No.: US 9,867,510 B2
(45) Date of Patent: Jan. 16, 2018

(54) FOOTBALL HELMET SHAPED TOILET PAPER DISPENSER

(71) Applicant: James A. Bethel, Capitol Heights, MD (US)

(72) Inventor: James A. Bethel, Capitol Heights, MD (US)

( * ) Notice: Subject to any disclaimer, the term of this patent is extended or adjusted under 35 U.S.C. 154(b) by 607 days.

(21) Appl. No.: 14/572,122

(22) Filed: Dec. 16, 2014

(65) Prior Publication Data

US 2015/0164291 A1 Jun. 18, 2015

Related U.S. Application Data

(60) Provisional application No. 61/916,382, filed on Dec. 16, 2013.

(51) Int. Cl.
*A47K 10/38* (2006.01)
*G08B 25/01* (2006.01)

(52) U.S. Cl.
CPC ..... *A47K 10/38* (2013.01); *G08B 25/016* (2013.01); *A47K 2010/389* (2013.01)

(58) Field of Classification Search
CPC . A47K 10/38; A47K 2010/389; G08B 25/016
See application file for complete search history.

(56) References Cited

U.S. PATENT DOCUMENTS 4,882,568 A * 11/1989 Kyser ..... A47K 10/32 200/61.16
6,628,789 B1 * 9/2003 Colby ..... A47K 10/38 242/599
2011/0046911 A1 * 2/2011 Studer ..... A47K 5/1217 702/108
2015/0274470 A1 * 10/2015 Nash ..... B65H 35/0026 242/595

* cited by examiner

*Primary Examiner* — William A. Rivera

(57) ABSTRACT

A football helmet shaped toilet paper dispenser holds a toilet paper roll and dispenses toilet paper from the roll. The football helmet shaped toilet paper dispenser includes a football helmet shaped housing, a faceguard lever, a toilet paper axle, a rotary sensor, and a sound system. The user actuates the faceguard lever to rotate the toilet paper axle and dispense toilet paper. Simultaneously, the rotary sensor assesses when the toilet paper axle is rotated and transmits a signal to active a fight song for a sport franchise. At least one button is positioned on the football helmet shaped housing such that the user may alert bystanders or emergency response personnel to come to the aid of the user.

17 Claims, 9 Drawing Sheets

FOOTBALL HELMET SHAPED TOILET PAPER DISPENSER

The current application claims a priority to the U.S. Provisional Patent application Ser. No. 61/916,382 filed on Dec. 16, 2013.

FIELD OF THE INVENTION

The present invention relates generally to a toilet paper dispenser. More specifically, the present invention relates to football helmet shaped toilet dispenser which emits an audio sound when the faceguard is pulled, as well as, provides a means to alert bystanders or emergency services for assistance.

BACKGROUND OF THE INVENTION

People sometimes choose to display their support of various sport franchises. Items for these various sport franchises can be very popular. Fans tend to collect items associated with their favorite sport franchise as a way to support the specific team as well as to support the sport as a whole. In addition, each team has a fight song which is uniquely theirs, which fans can identify with.

A toilet paper dispenser is one of the most essential items in a bathroom. By providing a place to mount toilet paper, this previous invention is found in most modern bathrooms. The toilet paper dispenser is generally very visible within a bathroom such that the user will be able to quickly find and use toilet paper when necessary.

Therefore, it is an object of the present invention to combine these ideas into a toilet paper dispenser which displays support for various American football franchises. The present invention dispenses toilet paper when a faceguard lever is pulled, subsequently playing a fight song or other audio media. At least one button will be located on the football helmet shaped housing allows the user to signal for assistance in-home or outside emergency help.

DETAIL DESCRIPTIONS OF THE INVENTION

All illustrations of the drawings are for the purpose of describing selected versions of the present invention and are not intended to limit the scope of the present invention.

Figure 1:
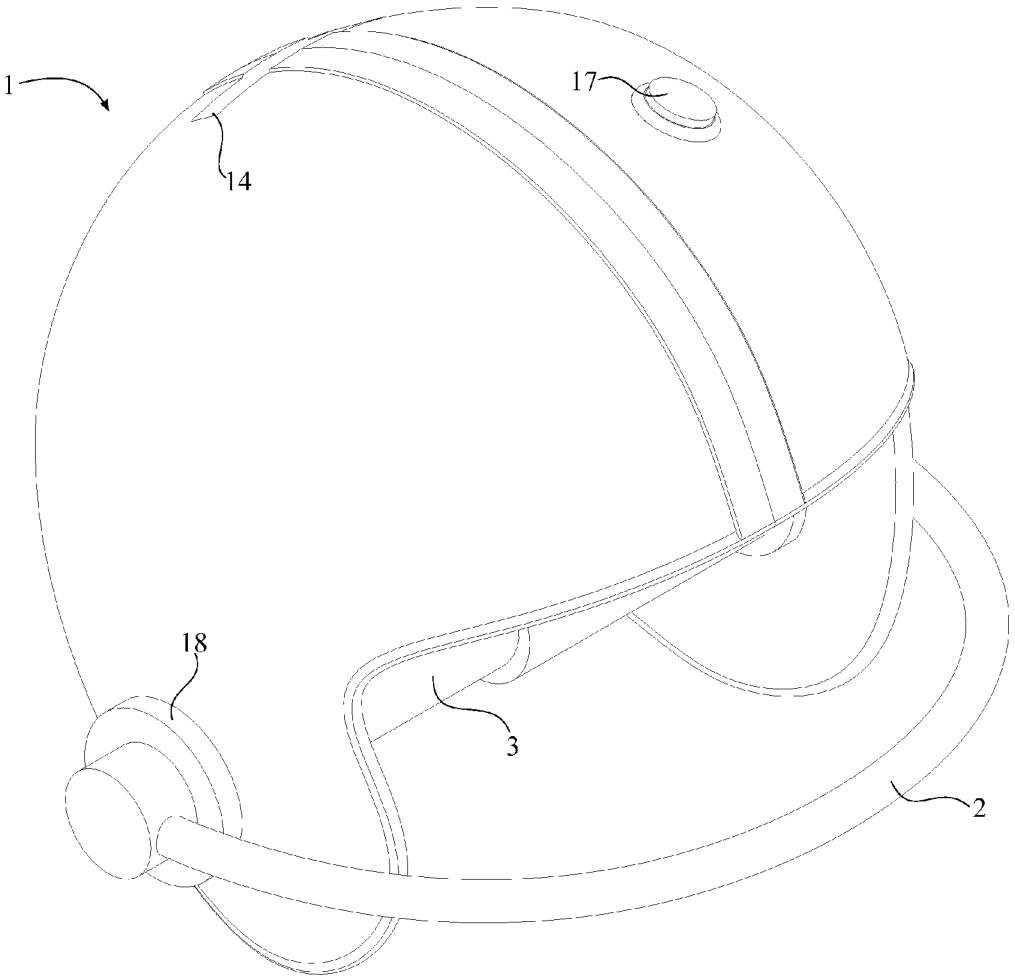
FIG. 1 is a perspective view from above the present invention.
Figure 2:
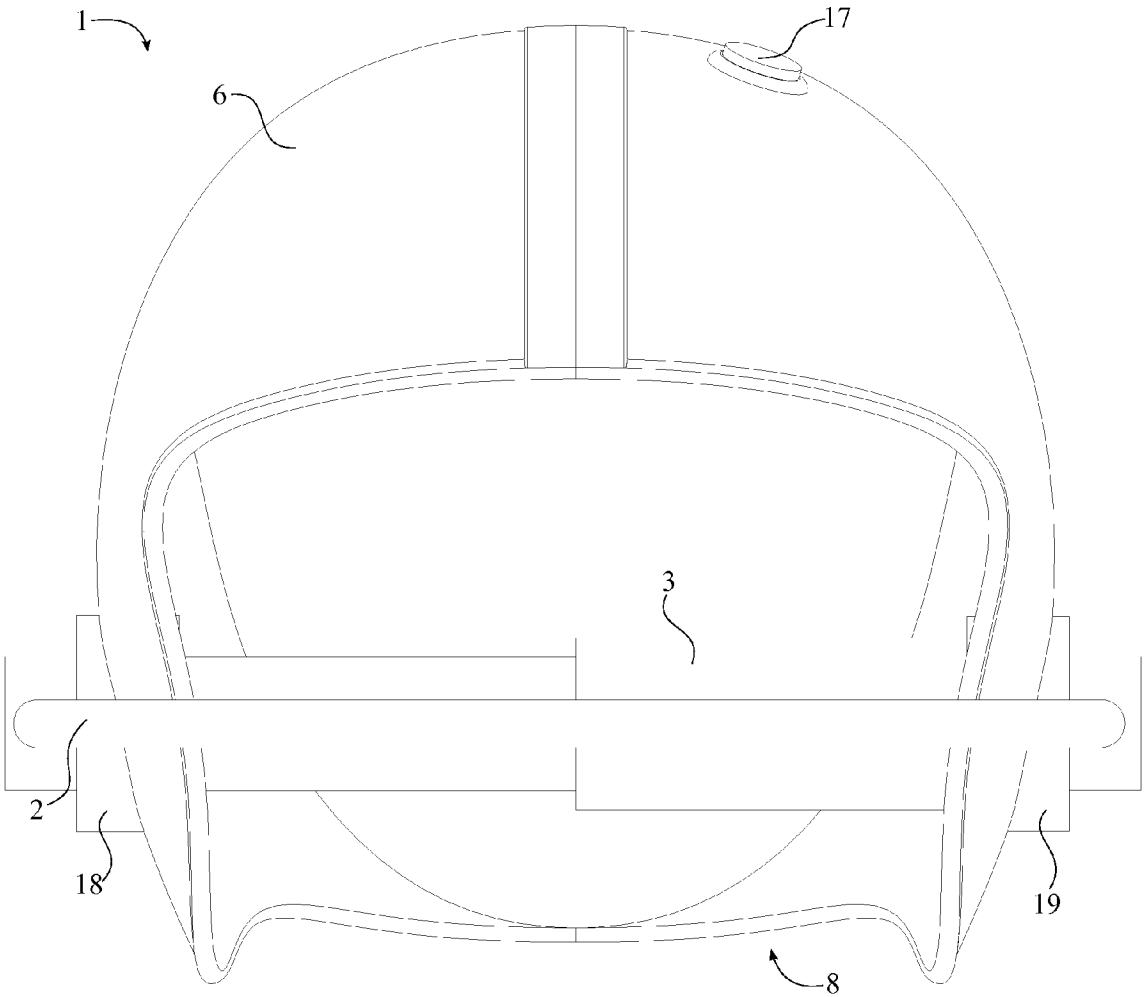
FIG. 2 is a front view of the present invention.
Figure 3:
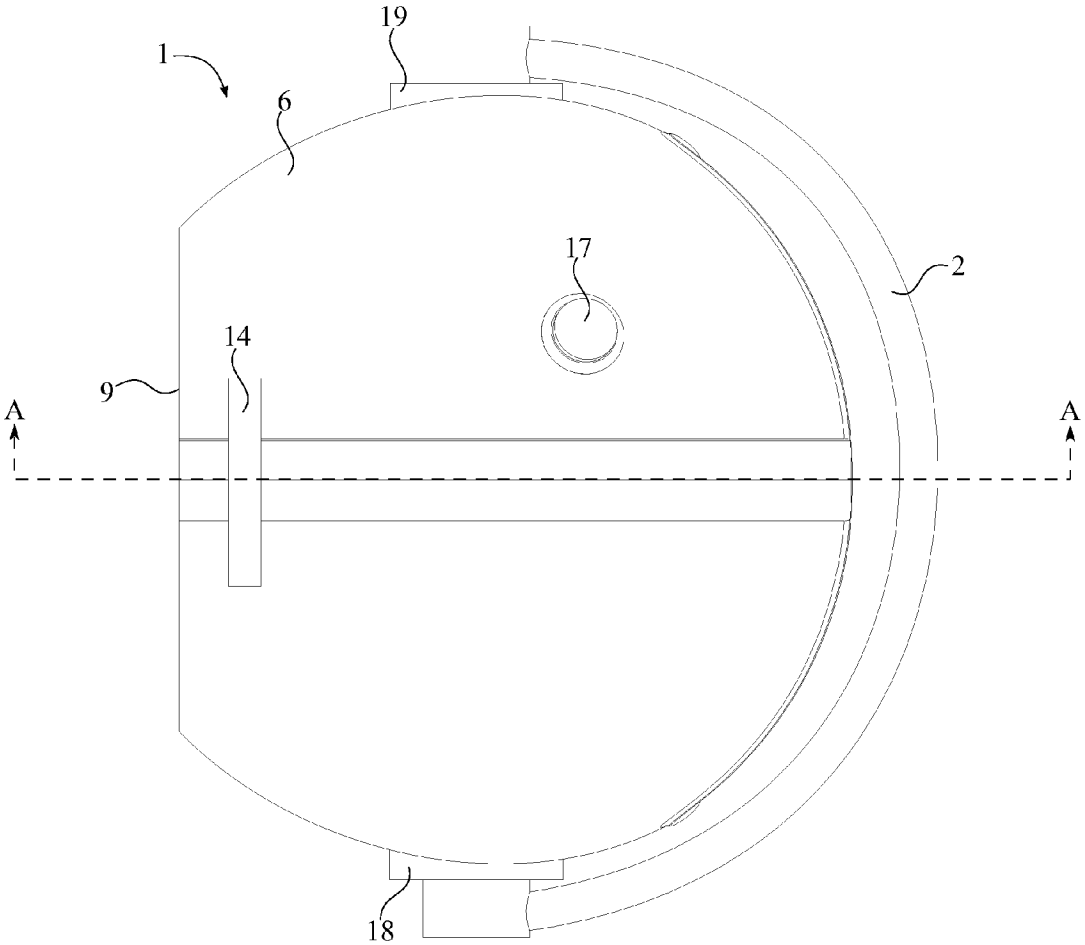
FIG. 3 is a top view of the present invention.
Figure 8:
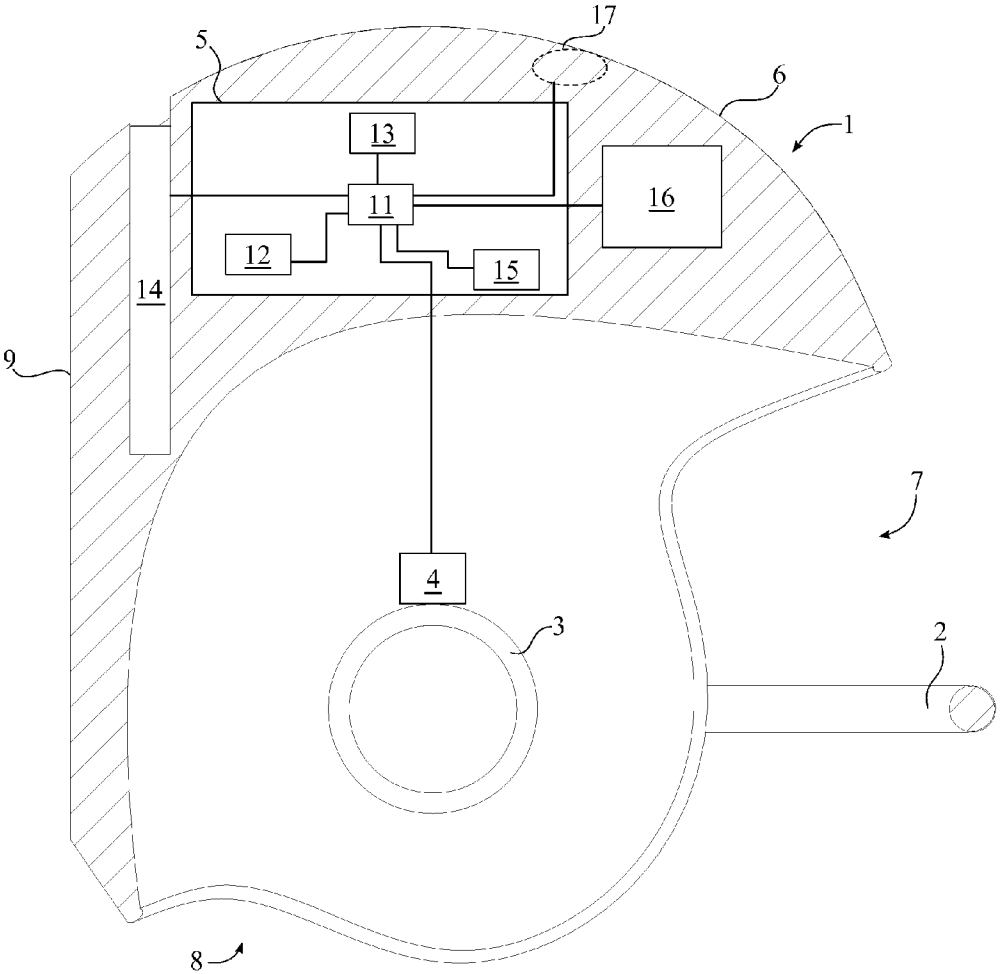
FIG. 8 is a schematic cross-sectional view of the electrical components of the present invention along the line A-A, as show in FIG. 3.

The present invention is for a football helmet shaped toilet paper dispenser, as shown in FIG. 1. The present invention allows the user to express support for their preferred football franchise while providing an emergency alert system for disabled or elderly users. The present invention comprises a football helmet shaped housing 1, a faceguard lever 2, a toilet paper axle 3, a rotary sensor 4, and a sound system 5, as depicted in FIG. 8. The football helmet shaped housing 1 is designed to resemble a modern American football helmet which contains and protects the electrical components of the present invention. When the faceguard lever 2 is actuated by the user, the preferred embodiment of the present invention dispenses toilet paper and emits a fight song via the sound system 5. Actuating the faceguard lever 2 simultaneously rotates the toilet paper axle 3 and subsequently triggering the rotary sensor 4 to play the fight song with the sound system 5. The toilet paper axle 3 is a removable support for a roll of toilet paper. The toilet paper axle 3 is removable such that a used roll of toilet paper can be exchanged for a new roll. In order to alert emergency response, the present invention further comprises at least one button 17.

The at least one button 17 is externally mounted onto the football helmet shaped housing 1, such that the user can easily access the at least one button 17. Once pressed, the at least one button 17 triggers the present invention to emit a high pitched sound to alert nearby persons or send a communication signal to emergency response personnel for assistance.

Figure 4:
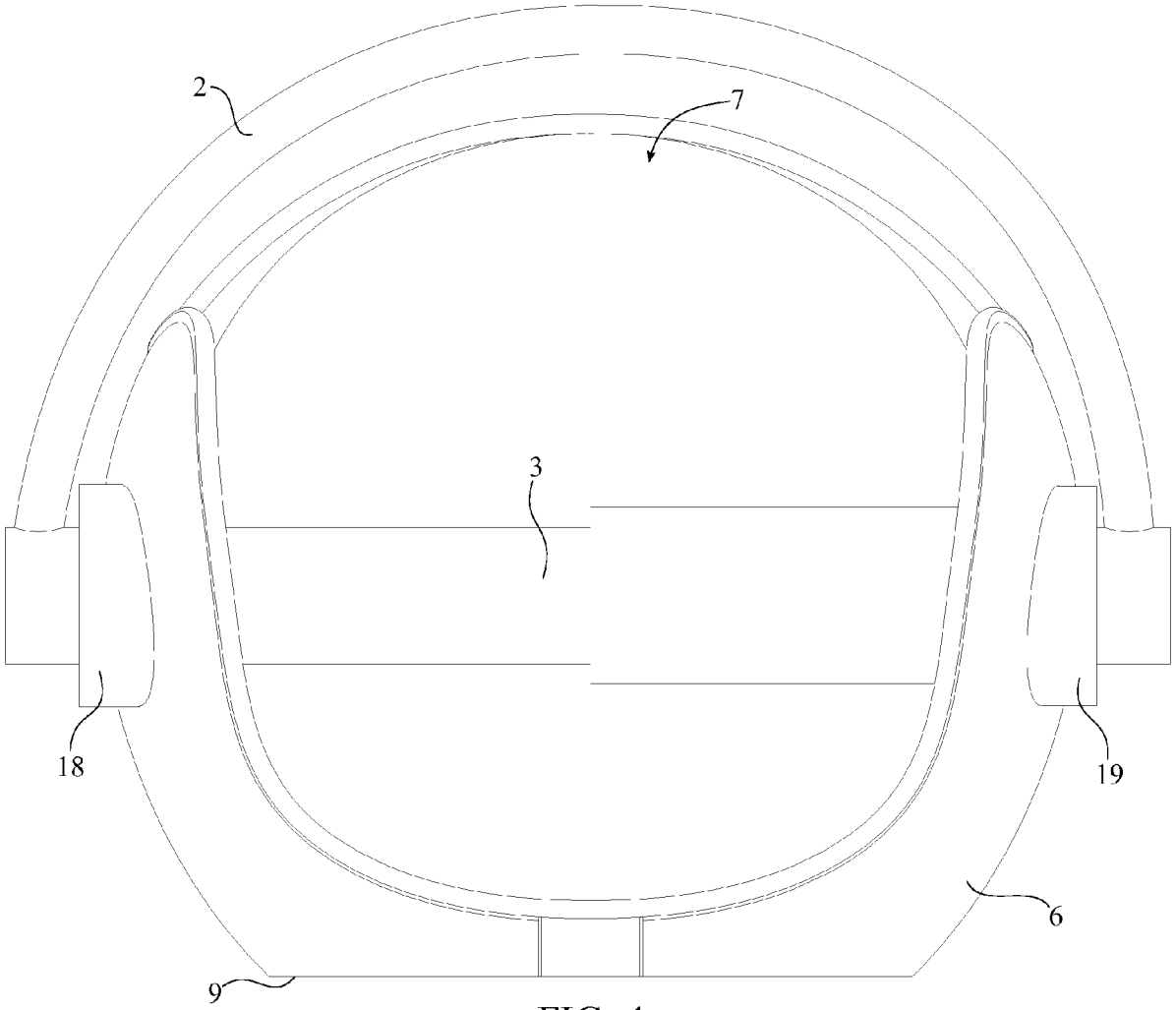
FIG. 4 is a bottom view of the present invention.
Figure 5:
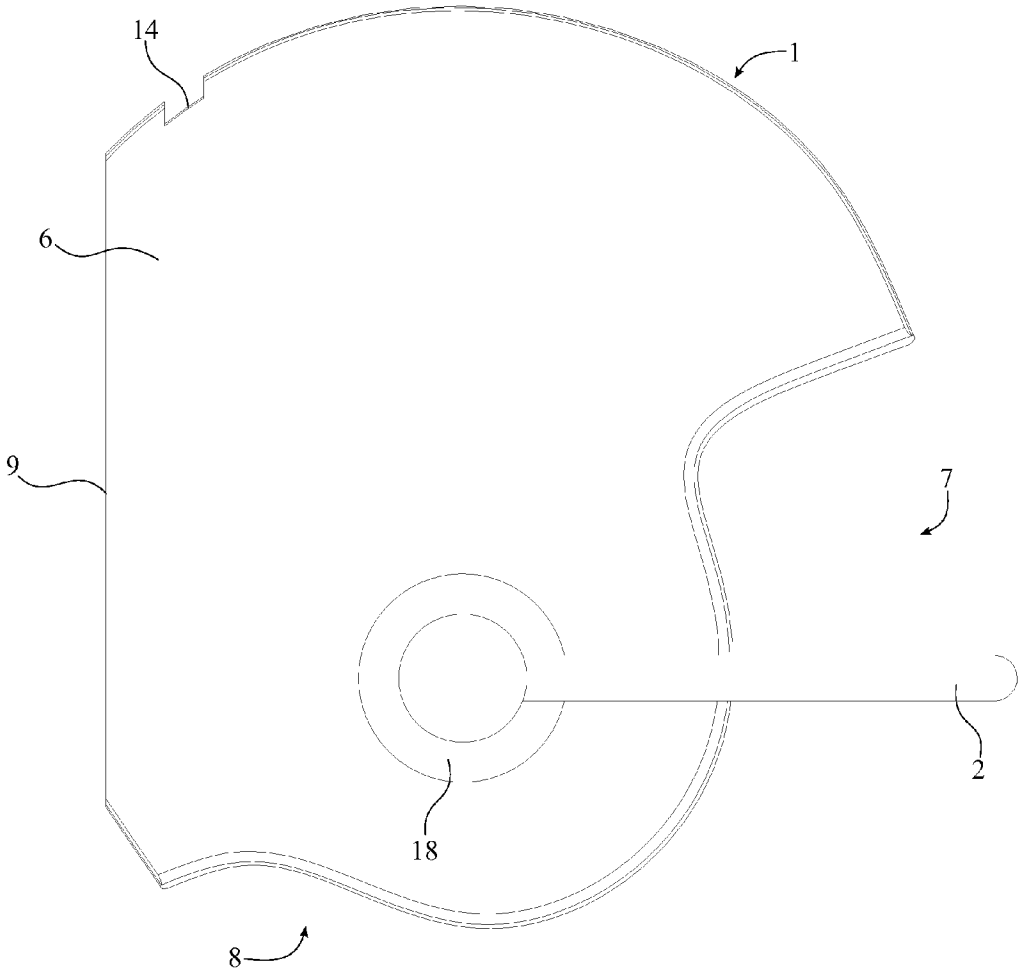
FIG. 5 is a left side view of the present invention.
Figure 6:
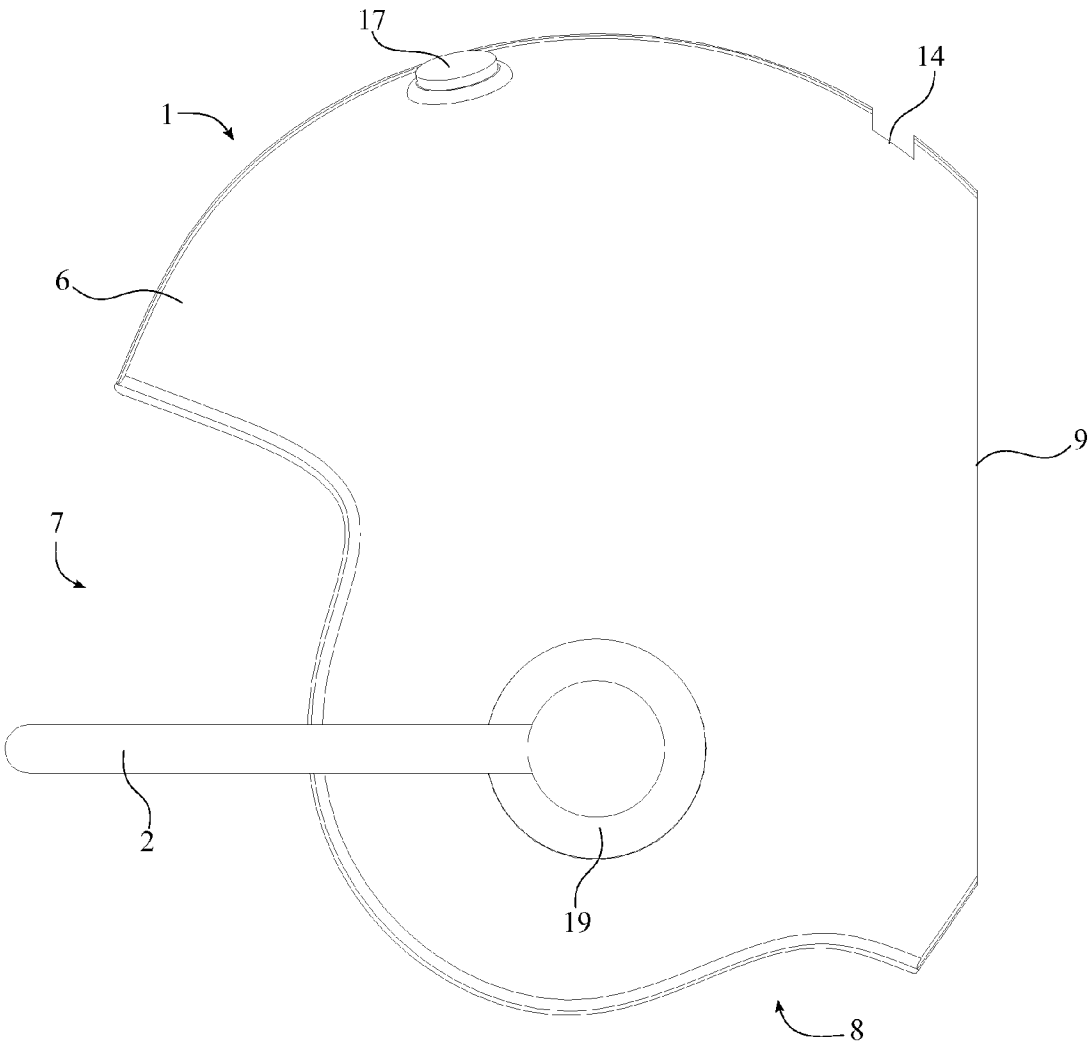
FIG. 6 is a right side view of the present invention.
Figure 7:
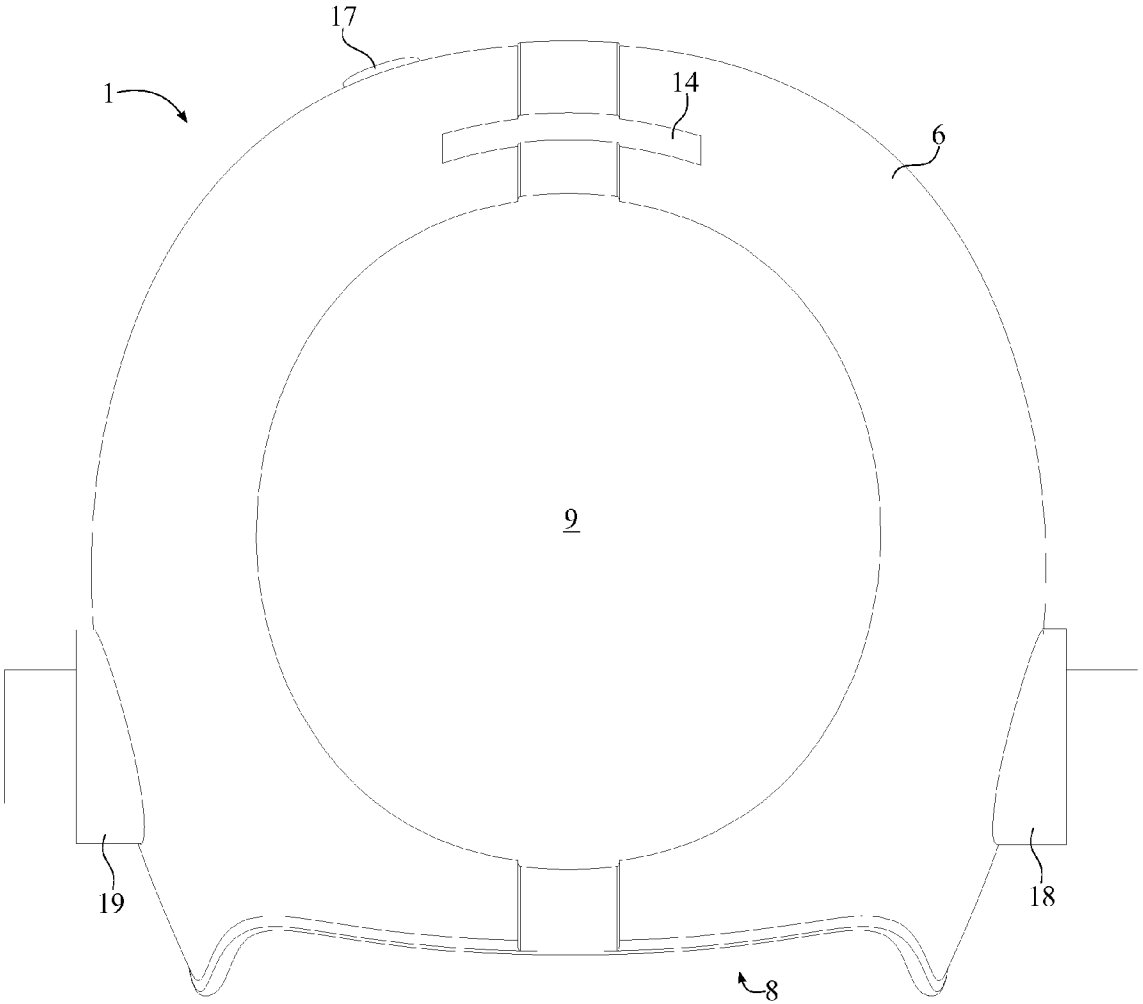
FIG. 7 is a rear view of the present invention.

As depicted in FIG. 5 and FIG. 6, the football helmet shaped housing 1 comprises a shell 6, a face opening 7, a neck opening 8, and a flat surface 9. The shell 6 is shaped like the shell 6 of a modern American football helmet; however, the shell 6 of the present invention houses electrical components within a compartment of the shell 6. The face opening 7 traverses into the shell 6, and the neck opening 8 traverses into the shell 6 perpendicular to the face opening 7. The face opening 7 and the neck opening 8 allow the user to access to the toilet paper axle 3 such that toilet paper can be easily retrieved and replaced. The flat surface 9 allows the present invention to be mounted flush against a wall. The flat surface 9 is externally integrated into the shell 6, opposite to the face opening 7, which allows the face opening 7 to be oriented away from the wall. The toilet paper axle 3 is rotatably mounted within the shell 6 parallel to the flat surface 9 as shown in FIG. 4 and FIG. 8. The toilet paper axle 3 is positioned such that toilet paper may be dispensed easily when the present invention is mounted onto a vertical support. The faceguard lever 2 is externally and pivotably connected about the shell 6 across the face opening 7, allowing the user to easily grip and maneuver the faceguard lever 2. The faceguard lever 2 is torsionally connected to the toilet paper axle 3 such that when the faceguard lever 2 is actuated the toilet paper axle 3 is simultaneously rotated. The sound system 5 is mounted within the shell 6 and is activated when either the faceguard lever 2 or the at least one button 17 is activated. The sound system 5 is either activated through use of the rotary sensor 4 or through use of the at least one button 17. The rotary sensor 4 is mounted adjacently to the toilet paper axle 3 to assess when the toilet paper axle 3 is rotated. The rotary sensor 4 is electronically connected to the sound system 5, such that when triggered, the rotary sensor 4 signals the sound system 5 to play the fight song or other audio media.

Figure 9:
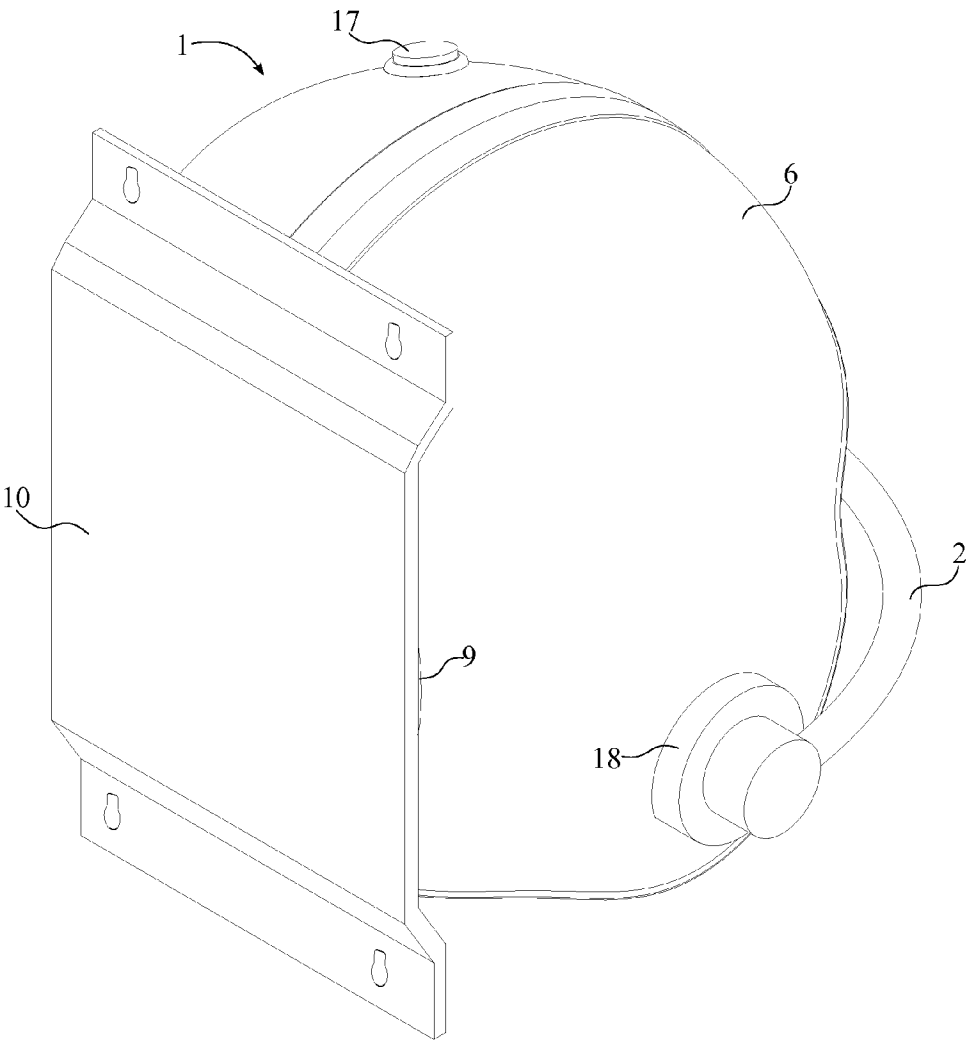
FIG. 9 is a rear perspective view of the present invention as mounted onto the mounting bracket.

In the preferred embodiment, the present invention further comprises a mounting bracket 10, as shown in FIG. 9. The mounting bracket 10 conforms to the rear of the shell 6, such that the mounting bracket 10 has a respective flat panel; however, the mounting bracket 10 includes at least one mounting support adjacently connected to the flat panel. The flat surface 9 engages the flat panel of the mounting bracket 10. The mounting bracket 10 provides additional support for mounting the present invention onto a vertical support and to keep the present invention flush against the vertical support.

The present invention also comprises a torsional recoiling mechanism 18, as shown in FIG. 2 to FIG. 5 and FIG. 7. The torsional recoiling mechanism 18 is operatively integrated between the faceguard lever 2 and the shell 6, wherein the torsional recoiling mechanism 18 returns the faceguard lever 2 to a resting position with respect to the shell 6. The torsional recoiling mechanism 18 is preferred to be a torsion spring, but is not limited to such. The resting position of the faceguard lever 2 is perpendicular to the flat surface 9 but the faceguard lever 2 is able to rotate about the toilet paper axle 3.

Further depicted in FIG. 2 to FIG. 4, FIG. 6, and FIG. 7, the present invention comprises a ratcheting mechanism 18. The ratcheting mechanism 18 allows the present invention to dispense toilet paper in set rotational interval. The ratcheting mechanism 18 is operatively integrated between the faceguard lever 2 and the toilet paper axle 3, wherein the ratcheting mechanism 18 incrementally rotates the toilet paper axle 3 when the faceguard lever 2 is actuated. In once specific embodiment of the present invention, the ratcheting mechanism 18 comprises a first ratchet wheel, a second ratchet wheel and a pawl. The first ratchet wheel and the second ratchet wheel each comprise saw-like teeth which the pawl engages to transfer motion from the faceguard level 2 to the toilet paper axle 3. The first ratchet wheel is mounted to the faceguard lever 2. The second ratchet wheel is mounted onto the toilet paper axle 3. The first ratchet wheel and the second ratchet wheel operatively engage the pawl. When the faceguard level is depressed, the first ratchet wheel rotates, driving the pawl into an oscillating motion. The motion of the pawl rotates the second ratchet wheel and therefore the toilet paper axle 3. When released, the faceguard lever 2 returns to the resting position.

In accordance to FIG. 8, the sound system 5 further comprises a chipset 11, a power source 12, and a speaker 13. The chipset 11 processes and controls the inputs from the rotary sensor 4 and the at least one button 17 to determine the audio output. The power source 12 provides electrical energy for the electronic components of the present invention and is electrically connected to the chipset 11. The power source 12 is preferred to be batteries, but includes and is not limited to an alternating current adapter, rechargeable batteries, or any other appropriate means of providing electrical power. The speaker 13 converts the electronic audio output into audible sound. The chipset 11, the power source 12 and the speaker 13 are positioned within the shell 6 for protection. The speaker 13, the rotary sensor 4, and the at least one button 17 are electronically connected to the chipset 11 such that the chipset 11 can manage the commands, input signals, and output signals between the speaker 13, the rotary sensor 4, and the at least one button 17.

In the preferred embodiment of the present invention, the sound system 5 further comprises an optical disc drive 14. The optical disc drive 14 allows the present invention to accept removable media in the form of compact discs, minidiscs, or other similar media storage. The optical disc drive 14 is integrated into the shell 6 and is electronically connected to the chipset 11. The chipset 11 accesses the media from the optical disc drive 14 when the faceguard lever 2 is actuated by the user and the signal from the rotary sensor 4 is transmitted to the chipset 11. Once the media is accessed, the media is outputted through the speaker 13. In an alternate embodiment, the present invention comprises a data storage device 15 to store audio media files. The data storage device 15 is positioned within the shell 6 and electronically connected to the chipset 11. Similar to the preferred embodiment, the chipset 11 accesses the media on the data storage device 15 when the faceguard lever 2 is actuated by the user and the signal from the rotary sensor 4 is transmitted to the chipset 11. Once the media is accessed, the media is outputted through the speaker 13.

In accordance to the preferred embodiment, actuation of the at least one button 17 causes the present invention to signal nearby persons of an emergency situation by emitting a high pitched noise. In another alternate embodiment, the present invention further comprises a wireless communication device 16. The wireless communication device 16 is preferred to be a Wi-Fi transmitter, but includes and is not limited to Bluetooth, mobile network transmitter, or similar wireless communicable devices. The wireless communication device 16 is positioned within the shell 6 and is also electronically connected to the chipset 11. The wireless communication device 16 allows the user to signal emergency response personnel in an emergency situation.

Although the invention has been explained in relation to its preferred embodiment, it is to be understood that many other possible modifications and variations can be made without departing from the spirit and scope of the invention as hereinafter claimed.

What is claimed is:

1. A football helmet shaped toilet paper dispenser comprises:

a football helmet shaped housing;

a faceguard lever;

a toilet paper axle;

a rotary sensor;

a sound system;

the football helmet shaped housing comprises a shell, a face opening, a neck opening, and a flat surface;

the face opening traversing into the shell;

the neck opening traversing into the shell perpendicular to the face opening;

the flat surface being externally integrated into the shell opposite to the face opening;

the toilet paper axle being rotatably mounted within the shell parallel to the flat surface;

the faceguard lever being externally and pivotably connected about the shell across the face opening;

the faceguard lever being torsionally connected to the toilet paper axle;

the sound system being mounted within the shell;

the rotary sensor being mounted adjacent to the toilet paper axle; and the rotary sensor being electronically connected to the sound system.

2. The football shaped toilet paper dispenser as claimed in claim 1 comprises:

a mounting bracket; and the flat surface being engaged to the mounting bracket.

3. The football shaped toilet paper dispenser as claimed in claim 1 comprises:

the sound system comprises a chipset, a power source, a speaker;

the power source, the chipset, and the speaker being positioned within the shell;

the speaker and the rotary sensor being electronically connected to the chipset; and the power source being electrically connected to the chipset.

4. The football shaped toilet paper dispenser as claimed in claim 3 comprises:

the sound system further comprises an optical disc drive;
the optical disc drive being integrated into the shell; and
the optical disc drive being electronically connected to the chipset.

5. The football shaped toilet paper dispenser as claimed in claim 3 comprises:
the sound system further comprises a data storage device;
the data storage device being positioned within the shell; and
the data storage device drive being electronically connected to the chipset.

6. The football shaped toilet paper dispenser as claimed in claim 3 comprises:
a wireless communication device;
the wireless communication device being positioned within the shell; and
the wireless communication device being electronically connected to the chipset.

7. The football shaped toilet paper dispenser as claimed in claim 1 comprises:
at least one button;
the at least one button being externally mounted onto the shell; and
the at least one button being electronically connected to the sound system.

8. The football shaped toilet paper dispenser as claimed in claim 1 comprises:
a torsional recoiling mechanism; and
the torsional recoiling mechanism being operatively integrated between the faceguard lever and the shell, wherein the torsional recoiling mechanism returns the faceguard lever to a position with respect to the shell.

9. The football shaped toilet paper dispenser as claimed in claim 1 comprises:
a ratcheting mechanism; and
the ratcheting mechanism being operatively integrated between the faceguard lever and the toilet paper axle, wherein the ratcheting mechanism incrementally rotates the toilet paper axle when the faceguard lever is actuated.

10. A football helmet shaped toilet paper dispenser comprises:
a football helmet shaped housing;
a faceguard lever;
a toilet paper axle;
a rotary sensor;
a sound system;
at least one button;
the football helmet shaped housing comprises a shell, a face opening, a neck opening, and a flat surface;
the face opening traversing into the shell;
the neck opening traversing into the shell perpendicular to the face opening;
the flat surface being externally integrated into the shell opposite to the face opening;
the toilet paper axle being rotatably mounted within the shell parallel to the flat surface;
the faceguard lever being externally and pivotably connected about the shell across the face opening;
the faceguard lever being torsionally connected to the toilet paper axle;
the sound system being mounted within the shell;
the rotary sensor being mounted adjacent to the toilet paper axle;
the rotary sensor being electronically connected to the sound system;
the at least one button being externally mounted onto the shell; and
the at least one button being electronically connected to the sound system.

11. The football shaped toilet paper dispenser as claimed in claim 10 comprises:
a mounting bracket; and
the flat surface being engaged to the mounting bracket.

12. The football shaped toilet paper dispenser as claimed in claim 10 comprises:
the sound system comprises a chipset, a power source, a speaker;
the power source, the chipset, and the speaker being positioned within the shell;
the speaker and the rotary sensor being electronically connected to the chipset; and
the power source being electrically connected to the chipset.

13. The football shaped toilet paper dispenser as claimed in claim 12 comprises:
the sound system further comprises an optical disc drive;
the optical disc drive being integrated into the shell; and
the optical disc drive being electronically connected to the chipset.

14. The football shaped toilet paper dispenser as claimed in claim 12 comprises:
the sound system further comprises a data storage device;
the data storage device being positioned within the shell; and
the data storage device drive being electronically connected to the chipset.

15. The football shaped toilet paper dispenser as claimed in claim 12 comprises:
a wireless communication device;
the wireless communication device being positioned within the shell; and
the wireless communication device being electronically connected to the chipset.

16. The football shaped toilet paper dispenser as claimed in claim 10 comprises:
a torsional recoiling mechanism; and
the torsional recoiling mechanism being operatively integrated between the faceguard lever and the shell, wherein the torsional recoiling mechanism returns the faceguard lever to a resting position with respect to the shell.

17. The football shaped toilet paper dispenser as claimed in claim 10 comprises:
a ratcheting mechanism; and
the ratcheting mechanism being operatively integrated between the faceguard lever and the toilet paper axle, wherein the ratcheting mechanism incrementally rotates the toilet paper axle when the faceguard lever is actuated.

* * * * *